United States Patent [19]

Heatwole

[11] Patent Number: 4,530,498

[45] Date of Patent: Jul. 23, 1985

[54] AMUSEMENT AND/OR EXERCISING DEVICE

[76] Inventor: Richard L. Heatwole, 1516 Ardmore, Fort Wayne, Ind. 46804

[21] Appl. No.: 426,350

[22] Filed: Sep. 29, 1982

[51] Int. Cl.[3] ..... A63B 23/04

[52] U.S. Cl. ..... 272/146; 272/70

[58] Field of Search ..... 272/70, 96, 97, 93, 272/146, 144, 54–56, 110–114; 273/80.1; 128/25 B

[56] References Cited

U.S. PATENT DOCUMENTS

| | | | |
|---|---|---|---|
| 2,471,528 | 5/1949 | Kling | 272/56 |
| 2,714,007 | 7/1955 | Jordan | 272/146 |
| 3,480,274 | 11/1969 | Boggild et al. | 272/110 |
| 3,560,035 | 2/1971 | Kindel | 273/80.1 X |
| 3,764,131 | 10/1973 | Rooks | 272/132 |
| 3,834,695 | 9/1974 | Boggild et al. | 272/110 |
| 3,836,140 | 9/1974 | Ahrens | 272/54 |
| 3,854,717 | 12/1974 | Judkins et al. | 272/114 |
| 3,923,302 | 12/1975 | Boggild | 272/110 |
| 4,252,312 | 2/1981 | Dehan | 272/146 |
| 4,285,516 | 8/1981 | Heatwole | 272/146 |

*Primary Examiner*—Richard J. Apley
*Assistant Examiner*—S. R. Crow
*Attorney, Agent, or Firm*—Seidel, Gonda & Goldhammer

[57] ABSTRACT

First and second pads are connected by a member which is wider at the bottom than at the top. Each pad has a ground engaging element associated therewith. A generally semi-spherical bearing is provided between each ground engaging element and its associated pad so that the pads may tilt and/or rotate relative to their ground engaging element. A removable insert is provided for limiting maneuverability and thereby facilitating ease of maintaining balance by beginners.

8 Claims, 8 Drawing Figures

AMUSEMENT AND/OR EXERCISING DEVICE

BACKGROUND OF THE INVENTION

The present invention is directed to an improvement over my prior U.S. Pat. No. 4,285,516 dated Aug. 25, 1982 and entitled Amusement and/or Exercising Device. The present invention improves the device disclosed in said patent in a number of areas including ease of manufacture, providing for increased resistance to twisting, providing for ease of learning to use the device, etc.

SUMMARY OF THE INVENTION

The present invention is directed to an amusement and/or exercising device having first and second pads spaced from each other. Each pad is adapted to support one leg of a person. A means integral with the pads and having a cross section which resists twisting is provided for rigidly interconnecting the pads. A discrete ground engaging element is provided below and is associated with each pad. A bearing socket approximately ¾ of a sphere is provided on the bottom of each pad.

A bearing is located in each socket. Each bearing is rigidly connected to one of the ground engaging elements. Each pad is pivotable relative to its associated bearing through a limited arc to thereby facilitate tilting the pads as a unit so that one pad is higher than the other and off the ground. A removable means is provided for permitting the pads to rotate through a limited arc relative to its associated ground engaging element about a vertical axis.

Various objects and advantages of the present invention are set forth hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 8:
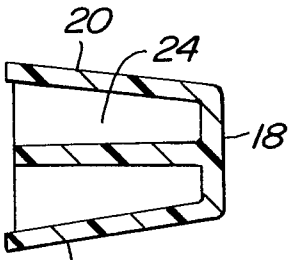
FIG. 8 is a sectional view taken along the line 8—8 in FIG. 2.

The device 10 includes a pair of pads designated 12 and 14. The pads are rigidly connected together and are integral in one piece by way of a connecting means 16. The connecting means 16 includes a top wall 18 and side walls 20, 22. As shown more clearly in FIG. 8, the side walls 20, 22 converge upwardly so that the distance across the bottom of connecting means 16 is greater than the distance across the top wall 18. That feature in combination with the criss-cross ribbing 24 provides substantial stability and resistance to twisting. As will be apparent from FIG. 8, the connecting means 16 is generally an inverted U-shape in cross section.

Figure 1:
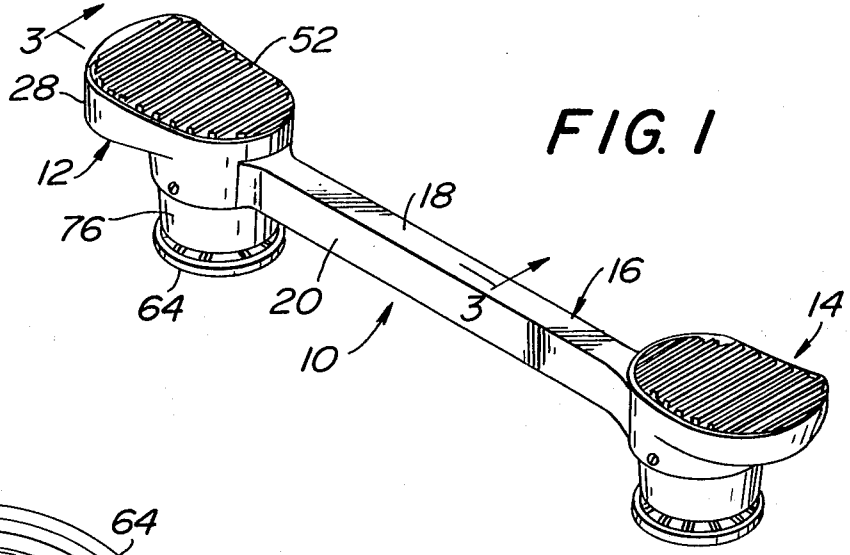
FIG. 1 is a perspective view of the device of the present invention.
Figure 2:
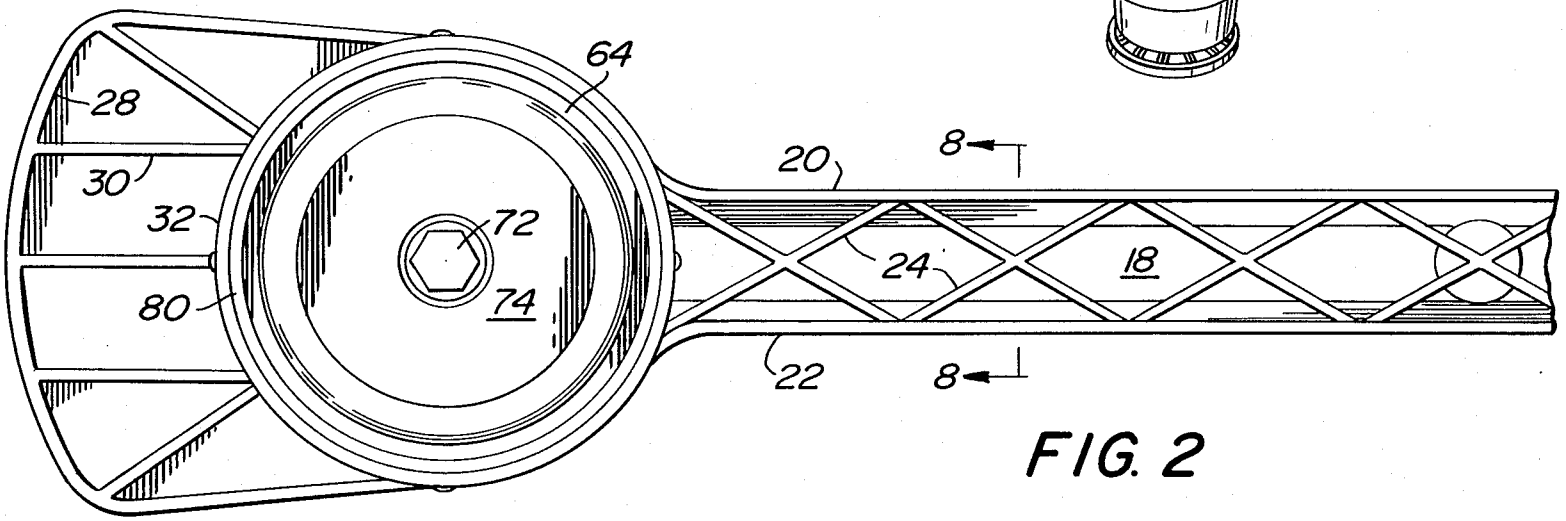
FIG. 2 is a bottom plan view at one end of the device.
Figure 3:
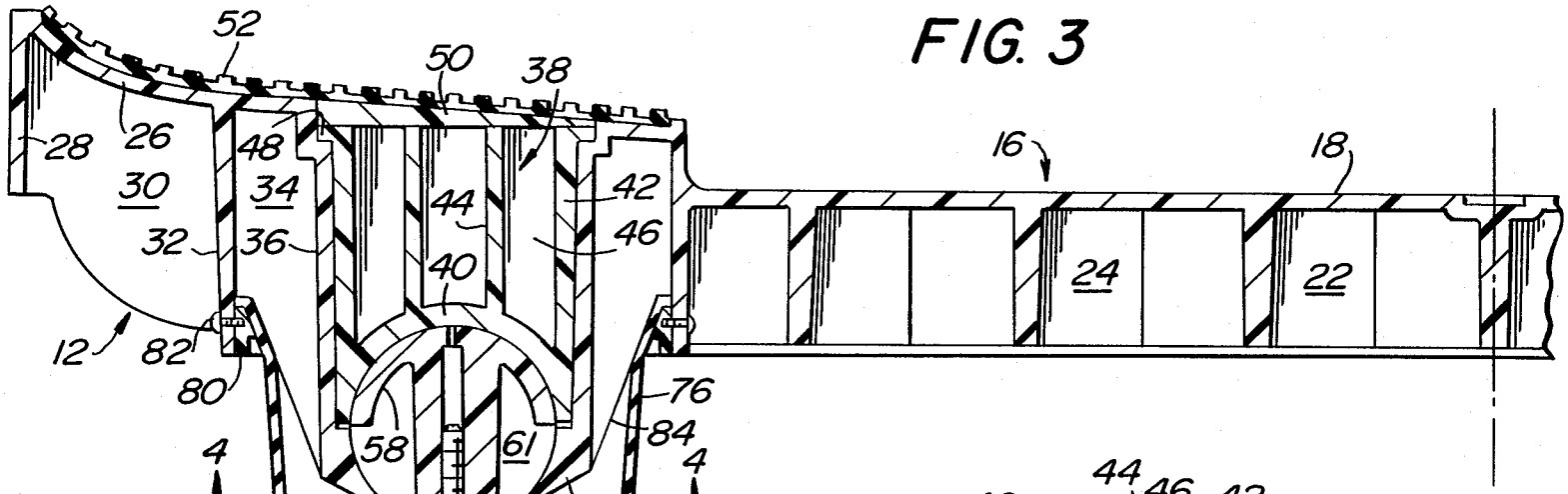
FIG. 3 is a sectional view taken along the line 3—3 in FIG. 1 but on an enlarged scale.

The pads 12 and 14 are identical. Hence, only pad 12 would be described in detail. Referring to FIGS. 2 and 3, it will noted that the pad 12 has a top wall 26 which is arced upwardly at its outer periphery and connected to a depending peripheral side wall 28. Side wall 28 is connected by way of a plurality of ribs 30 to a first cylindrical wall 32. Wall 32 is integral with and depends from the top wall 26. A second cylindrical wall 36 is integral with and depends from the top wall 26. Wall 36 is longer than wall 32 and is radially inwardly thereof. The walls 32 and 36 are connected by a plurality of radially disposed ribs 34. A bearing retainer designated generally as 38 is disposed within the second cylindrical wall 36.

As shown more clearly in FIG. 3, the bearing retainer 38 has a generally semi-spherical end wall 40 at one end of a cylindrical outer wall 42. End wall 40 is also integral on one piece with an inner cylindrical wall 44. The walls 42, 44 are interconnected by radially disposed ribs 46. The upper end of cylindrical wall 42 has an outwardly projecting flange 48 supported by a shoulder at the upper end of cylindrical wall 36. A cover 50 overlies the bearing insert 38. An anti-slip covering 52 overlies and is bonded to the upper surface of cover 50 and the top wall 26 of the pad 12. It will be noted that cover 50 is of non uniform thickness so as to form a continuation of the top wall 26.

Figure 4:
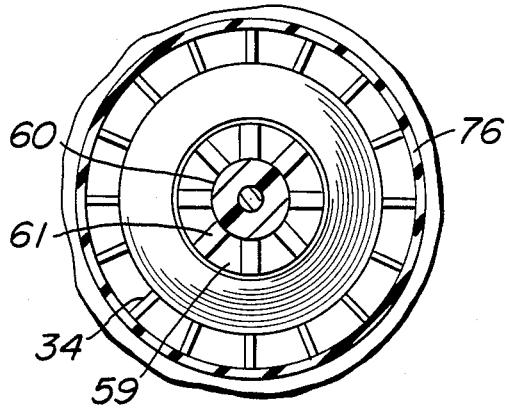
FIG. 4 is a sectional view taken along the line 4—4 in FIG. 3.

The lower end of cylindrical wall 36 is provided with a radially inwardly extending projection 54. See FIG. 3. Projection 54 terminates in a conical hole 56. The inner surface of projection 54, except for the hole 56, is a semi-spherical surface which mates with the semi-spherical surface on the retainer end wall 40. A generally spherical bearing 58 is retained by said two semi-spherical surfaces. Bearing 58 has a axial stem 60 which is cylindrical. The bearing 58 is solid except for a plurality of cut-out areas 59 uniformly distributed around the bottom half of the bearing 58 to thereby define a plurality of radially disposed ribs 61. See FIG. 4. In the area of the ribs, the bearing 58 is completely spherical.

Figure 7:
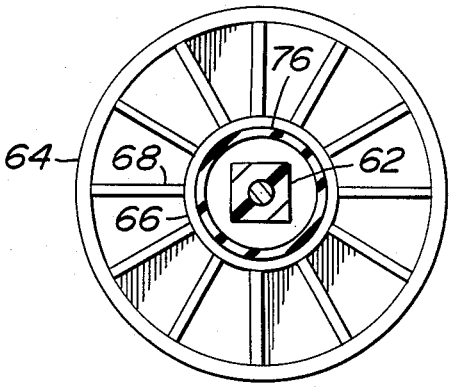
FIG. 7 is a sectional view taken along the line 7—7 in FIG. 5.

The cylindrical stem 60 on the bearing 58 terminates at its free end in a projection 62 which is non-circular in cross section. As shown in FIG. 7, projection 62 is rectangular in section. A means is provided for releasibly interconnecting stem 60 with a ground engaging element 64. Element 64 has a raised central hub 66 interconnected with the periphery of the element 64 by a plurality of radially disposed ribs 68 on the upper surface thereof. See FIG. 7. Hub 66 has a central bore enlarged at its upper end to mate with and receive the projection 62. Hence, bearing 68 cannot rotate relative to ground engaging element 64.

The bottom end of the central bore of hub 66 is enlarged so as to define recess 70. Within recess 70 there is received the head of a bolt 72. Bolt 72 is threaded to an internal bore in the stem 60 and bearing 58. The bottom surface of element 64 is recessed to receive a rubber pad 74. Pad 74 is an anti-skid and anti-slip layer so as to minimize movement between element 64 and a supporting surface such as a floor. Pad 74 occupies substantially the entire bottom surface of element 64.

A flexible resilient enclosure 76 is provided. The lower end of enclosure 76 is provided with a flange received in an annular groove on the top wall of hub 66. A washer 78 overlies the lower end portion of enclosure 76 and engages a shoulder on the stem 60. Hence, tightening of bolt 72 connects bearing 58 to element 64 and at the same time connects the lower end of enclosure 76 to the element 64.

An annular retainer 80 is removably attached to the lower end of the cylindrical wall 32 by a plurality of fasteners 82. Retainer 80 maintains the upper end of the enclosure 76 in contact with the beveled surface 84 on the ribs 34. Enclosure 76 is made from a rubber-like or elastomeric material and prevents foreign matter from entering the area of the bearing 38 and also prevents a child from having his fingers squeezed in the area of the bearing while playing with the device 10.

Figure 5:
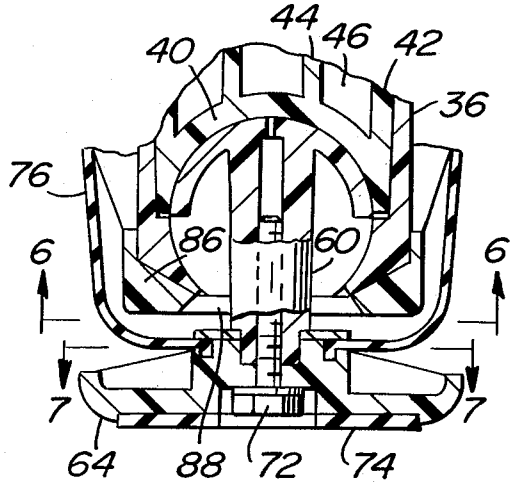
FIG. 5 is a sectional view through the bearing with the removable insert applied thereto.
Figure 6:
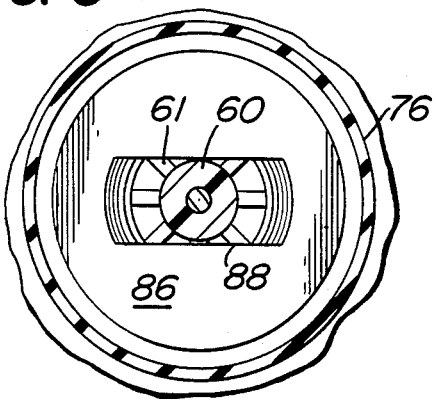
FIG. 6 is a sectional view taken along the line 6—6 in FIG. 5.

Beginners have difficulty learning how to maintain their balance on the device 10. To facilitate training beginners, the device 10 is preferably provided with an insert 86 as shown in FIGS. 5 and 6. Insert 86 is removably attached to the lower end of cylindrical wall 36. Insert 86 has a conical opening 88 which coincides with and forms an extension of the opening 56. However, opening 88 is generally elliptical with its major axis lying along the axis of the device 10. Hence, opening 88 will not interfere with the ability of the beginner to tilt pad 14 relative to pad 12 with pad 14 being higher than pad 12 and off the ground. However, insert 86 will limit the extent of tilting of pad 12 relative to its bearing 58 in a direction corresponding to the minor axis of the elliptical opening 88. As soon as a beginner develops the necessary confidence and skill to maintain his balance, insert 86 is easily removed as follows. Fasteners 82 are removed. Bolt 72 is removed. This facilitates access to removal of the insert 86. Thereafter, bolt 72 is reapplied and fasteners 82 are reapplied.

The device 10 is preferably molded from a polymeric plastic material such as DELRIN except as follows. Coating 52, pad 74, and enclosure 76 are preferably made from neoprene rubber having a Shore durometer of 80–90. The pads 12 and 14, connecting means 16, and cover 50 are preferably made from A.B.S. (acrylonitrile-butadiene-styrene copolymer) such as the material sold under the trademark CYCOLAC. Other equivalent polymeric plastics may be used.

The device 10 is easier to use for beginners, while being easier to manufacture and assemble. At the same time, the device 10 is more resistant to torsional twisting along the connecting means. The device 10 is lighter in weight and uses less plastic than that disclosed in the above mentioned patent.

The present invention may be embodied in other specific forms without departing from the spirit or essential attributes thereof and, accordingly, reference is made to the appended claims, rather than to the foregoing specification, as indicating the scope of the invention.

We claim:

1. An amusement and/or exercising device comprising first and second pads spaced from each other, each pad being adapted to support one leg of a person, means integral with the pads and having a ribbed cross section which resists twisting and rigidly interconnecting said pads, a discrete ground engaging element below and associated with each pad, each pad having a hollow means defining at its lower end a bearing socket approximately three-quarters of a sphere, each hollow means including concentric walls extending upwardly from its associated socket with one of the concentric walls being supported by a shoulder on the outer concentric wall of its associated pad, said socket being partially defined by the lower end of said outer concentric wall, a generally spherical bearing in each socket, means releasably connecting each bearing in a rigid manner to one of said ground engaging elements, each pad being pivotable relative to its associated bearing through a limited arc to thereby facilitate tilting the pads as a unit with one pad being higher than the other and off the ground, and removable means for permitting each pad to rotate through a limited arc relative to its associated ground engaging element only in a lengthwise direction of said device.

2. A device in accordance with claim 1 wherein said last mentioned means has a generally elliptical shaped opening through which a stem connects the bearing to its associated ground engaging element, the major axis of said opening being generally parallel to the connecting means.

3. A device in accordance with claim 1 wherein said last mentioned means includes an enclosure surrounding each bearing, each enclosure being resilient and having one end releasably connected to a ground engaging element by a means which also releasably interconnects each bearing to its associated ground engaging element, the other end of each enclosure being attached to its associated pad by releasable fasteners.

4. A device in accordance with claim 1 wherein said first mentioned means is an inverted U-shaped member in section, the transverse dimension of said member at the lower end thereof being greater than the transverse dimension of said member at the upper end thereof, and said reinforcing ribbing extending between the side walls of said member.

5. A device in accordance with claim 1 wherein each pad is hollow with spaced concentric cylindrical walls depending from a top wall and inwardly from a peripheral side wall which also depends from the top wall.

6. An amusement and/or exercising device comprising first and second pads spaced from each other and rigidly connected to each other, each pad being hollow with spaced concentric cylindrical walls depending from a top wall, the inner cylindrical wall having a bearing retainer therein, said bearing retainer having a semi-spherical lower end face and being insertable into said inner cylindrical wall through an opening in the top wall of said pad, a generally spherical bearing within the lower end of said inner cylindrical wall, the bottom end of said inner cylindrical wall forming part of the socket for said bearing and having an opening, a stem attached to said bearing and extending downwardly through said opening and being removably connected to a ground engaging element, an enclosure of elastomeric material having one end releasably coupled to a hub on the ground engaging element, the other end of said enclosure being releasably connected to the outer cylindrical wall, and said top wall having a depending side wall connected at its ends to said outer cylindrical wall.

7. A device in accordance with claim 6 wherein said spherical bearing is provided with a plurality of cut out portions defining ribs therebetween, a central bore in said bearing, a fastener threaded to said central bore and releasably connecting said bearing to said ground engaging element.

8. A device in accordance with claim 6 including means removably attached to the lower end of said inner cylindrical wall for limiting pivotable movement between the pads and their associated ground engaging elements only to a lengthwise direction.

* * * * *